US009865420B2

(12) United States Patent
Kubono

(10) Patent No.: US 9,865,420 B2
(45) Date of Patent: Jan. 9, 2018

(54) ELECTROMAGNETIC RELAY

(71) Applicant: FUJITSU COMPONENT LIMITED, Tokyo (JP)

(72) Inventor: Kazuo Kubono, Tokyo (JP)

(73) Assignee: FUJITSU COMPONENT LIMITED, Tokyo (JP)

( * ) Notice: Subject to any disclaimer, the term of this patent is extended or adjusted under 35 U.S.C. 154(b) by 0 days.

(21) Appl. No.: 15/323,754

(22) PCT Filed: Jul. 16, 2015

(86) PCT No.: PCT/JP2015/070407
§ 371 (c)(1),
(2) Date: Jan. 4, 2017

(87) PCT Pub. No.: WO2016/013485
PCT Pub. Date: Jan. 28, 2016

(65) Prior Publication Data

US 2017/0162353 A1 Jun. 8, 2017

(30) Foreign Application Priority Data

Jul. 23, 2014 (JP) ..... 2014-149904
Aug. 7, 2014 (JP) ..... 2014-161825

(51) Int. Cl.
*H01H 9/30* (2006.01)
*H01H 50/28* (2006.01)
(Continued)

(52) U.S. Cl.
CPC ..... *H01H 50/28* (2013.01); *H01H 50/38* (2013.01); *H01H 50/54* (2013.01); *H01H 51/29* (2013.01)

(58) Field of Classification Search
CPC ..... H01H 50/14; H01H 50/02; H01H 50/22; H01H 50/24; H01H 50/28; H01H 50/36;
(Continued)

(56) References Cited

U.S. PATENT DOCUMENTS 3,017,474 A * 1/1962 Huetten ..... H01H 50/20 335/179
5,041,870 A * 8/1991 Imai ..... H01H 50/042 335/202
(Continued)

FOREIGN PATENT DOCUMENTS

EP 2672497 12/2013
JP 2001-118451 4/2001
(Continued)

OTHER PUBLICATIONS

International Search Report dated Oct. 6, 2015.

*Primary Examiner* — Shawki S Ismail
*Assistant Examiner* — Lisa Homza
(74) *Attorney, Agent, or Firm* — IPUSA, PLLC

(57) ABSTRACT

An electromagnetic relay includes a fixed contact portion including a fixed contact; a movable contact portion including a movable contact that contacts the fixed contact; and an electromagnetic device that operates the movable contact portion so that the movable contact contacts the fixed contact, and includes an armature that adsorbs to a magnetic core surface of the electromagnetic device and operates the movable contact portion by rotating with respect to a fulcrum, a hinge spring that pushes a part of the armature at an opposite side of the magnetic core surface while interposing the fulcrum therebetween so that the armature moves away from the magnetic core surface, and a fixed member that fixes an end portion of the hinge spring while having outside of a side surface of the armature as a fixed position, and wherein the fixed member is configured to fix the end
(Continued)

portion of the hinge spring by moving the hinge spring from an upper side to a lower side of the armature, when attaching the hinge spring.

8 Claims, 18 Drawing Sheets

(51) Int. Cl.
*H01H 51/29* (2006.01)
*H01H 50/38* (2006.01)
*H01H 50/54* (2006.01)

(58) Field of Classification Search
CPC ..... H01H 50/38; H01H 50/54; H01H 50/56; H01H 50/58; H01H 50/60; H01H 1/06; H01H 33/182
USPC ..... 335/201
See application file for complete search history.

(56) References Cited

U.S. PATENT DOCUMENTS 5,239,281 A * 8/1993 Tomono ..... H01H 50/042 335/128
6,265,958 B1 * 7/2001 Yoshino ..... H01H 50/023 335/128
6,359,537 B1 * 3/2002 Ichikawa ..... H01H 49/00 335/78
6,496,090 B1 * 12/2002 Nishida ..... H01H 50/023 335/128
6,700,466 B1 3/2004 Yamamoto et al.
6,879,229 B2 * 4/2005 Tanaka ..... H01H 50/46 335/128
6,903,639 B2 * 6/2005 Sanada ..... H01H 50/443 335/129
6,922,122 B2 * 7/2005 Saruwatari ..... H01H 50/642 335/113
6,924,719 B2 * 8/2005 Saruwatari ..... H01H 50/08 335/17
6,933,815 B2 * 8/2005 Saruwatari ..... H01H 50/08 335/17
7,205,870 B2 * 4/2007 Sanada ..... H01H 50/642 335/128
8,164,404 B2 * 4/2012 Kamiya ..... H01H 9/04 218/157
8,493,164 B2 * 7/2013 Kurihara ..... H01H 50/047 335/78
9,082,575 B2 7/2015 Yamashita et al.
2002/0036556 A1 * 3/2002 Matsuda ..... H01H 50/12 335/78
2004/0119566 A1 * 6/2004 Sanada ..... H01H 50/642 335/128
2005/0046527 A1 * 3/2005 Chida ..... H01H 50/002 335/78
2005/0057332 A1 * 3/2005 Nakamura ..... H01H 50/042 335/128
2006/0022778 A1 * 2/2006 Minowa ..... H01H 50/36 335/128
2008/0180197 A1 * 7/2008 Kubono ..... H01H 50/043 335/78
2009/0134962 A1 * 5/2009 Nishida ..... H01H 50/56 335/207
2010/0117769 A1 * 5/2010 Kuo ..... H01H 50/026 335/78
2011/0254645 A1 * 10/2011 Kubono ..... H01H 50/14 335/127
2013/0257566 A1 * 10/2013 Li ..... H01H 51/22 335/127
2014/0015628 A1 1/2014 Shinkai et al.
2014/0022035 A1 * 1/2014 Yamashita ..... H01H 9/443 335/201
2014/0159837 A1 * 6/2014 Hiraiwa ..... H01H 9/443 335/201
2015/0042425 A1 * 2/2015 Sumino ..... H01H 50/643 335/189
2015/0048909 A1 * 2/2015 Heinrich ..... H01H 50/041 335/85
2015/0194284 A1 7/2015 Uruma et al.
2016/0027602 A1 * 1/2016 Hasegawa ..... H01H 50/58 335/189
2016/0086754 A1 * 3/2016 Shimoda ..... H01H 50/28 335/2
2016/0372286 A1 * 12/2016 Kubono ..... H01H 9/443
2017/0133183 A1 * 5/2017 Hasegawa ..... H01H 50/14
2017/0162353 A1 * 6/2017 Kubono ..... H01H 50/28

FOREIGN PATENT DOCUMENTS

JP 2002-367499 12/2002
JP 2010-123545 6/2010
JP 2012-195102 10/2012
JP 2013-080692 5/2013
JP 2014-017086 1/2014
WO 2012/124165 9/2012

* cited by examiner

ELECTROMAGNETIC RELAY

FIELD

The present invention relates to an electromagnetic relay.

BACKGROUND

Electromagnetic relays in which a contact is opened and closed in accordance with an input of an electric signal are conventionally widely provided. Generally, the electromagnetic relays include a fixed contact portion, a movable contact portion that contacts the fixed contact portion, and an electromagnetic device that operates the movable contact portion. The electromagnetic device is further provided with an armature that is operated to rotate around an end portion of a yoke as a fulcrum. The armature is attached while being pushed in a predetermined direction by a hinge spring or the like, for example (see Patent Document 1).

Further, an arc-extinguishing function, that extinguishes ark discharge generated between the fixed contact portion and the movable contact portion, is actualized in the electromagnetic relay by disposing permanent magnets at both sides of the fixed contact portion and the movable contact portion. Further, by disposing an arc-extinguishing yoke around the permanent magnets, magnetic force by the permanent magnets can be increased and the arc-extinguishing capability can be improved.

PATENT DOCUMENTS

[Patent Document 1] Japanese Laid-open Patent Publication No. 2010-123545

[Patent Document 2] Japanese Laid-open Patent Publication No. 2014-17086

[Patent Document 3] Japanese Laid-open Patent Publication No. 2013-80692

[Patent Document 4] Japanese Laid-open Patent Publication No. 2012-195102

However, for the structure in which the hinge spring is disposed between the yoke and the movable contact portion as described in Patent Document 1, when assembling the electromagnetic relay, it is necessary for an operator to attach the hinge spring while avoiding an interference with the armature, and the assembling operation is not easy.

In order to make the electromagnetic relay into a small size, it is desired to take a countermeasure for disposing parts of the electromagnetic relay in a space-saving manner such as reducing the number of pieces smaller, in addition to form pieces of each of the parts smaller. Thus, it is desired to take a countermeasure for pieces related to the arc-extinguishing function to be disposed in a space-saving manner as well.

SUMMARY OF THE INVENTION

According to an aspect, it is a purpose to provide an electromagnetic relay capable of being easily assembled.

According to another aspect, it is a purpose to provide an electromagnetic relay capable of disposing pieces related to an arc-extinguishing function in a space-saving manner.

An electromagnetic relay of an embodiment has the following configuration. That is, an electromagnetic relay includes a fixed contact portion including a fixed contact; a movable contact portion including a movable contact that contacts the fixed contact; and an electromagnetic device that operates the movable contact portion so that the movable contact contacts the fixed contact, wherein the electromagnetic device includes an armature that adsorbs to a magnetic core surface of the electromagnetic device and operates the movable contact portion by rotating with respect to a fulcrum, a hinge spring that pushes a part of the armature at an opposite side of the magnetic core surface while interposing the fulcrum between the hinge spring and the magnetic core surface so that the armature moves away from the magnetic core surface, and a fixed member that fixes an end portion of the hinge spring while having outside of a side surface of the armature as a fixed position, and wherein the fixed member is configured to be capable of fixing the end portion of the hinge spring by moving the hinge spring from an upper side to a lower side of the armature, when attaching the hinge spring.

An electromagnetic relay of an embodiment has the following configuration. That is, an electromagnetic relay includes a fixed contact portion including a fixed contact; a movable contact portion including a movable contact that contacts the fixed contact; an electromagnet; a yoke, the yoke including a plurality of arc-extinguishing yoke portions that are disposed to face with each other while interposing the fixed contact and the movable contact therebetween; an armature, operated in accordance with an excitation of the electromagnet, that operates the movable contact portion between a position at which the fixed contact and the movable contact with each other, and a position at which the fixed contact and the movable contact are apart from each other; and a plurality of magnetic portions attached at one surfaces of the arc-extinguishing yoke portions, respectively, and disposed to face with each other while interposing the fixed contact and the movable contact therebetween.

According to the embodiment, an electromagnetic relay capable of being easily assembled can be provided.

Further, according to the embodiment, an electromagnetic relay capable disposing pieces related to an arc-extinguishing function in a space-saving manner can be provided.

DESCRIPTION OF EMBODIMENTS

Figure 1:
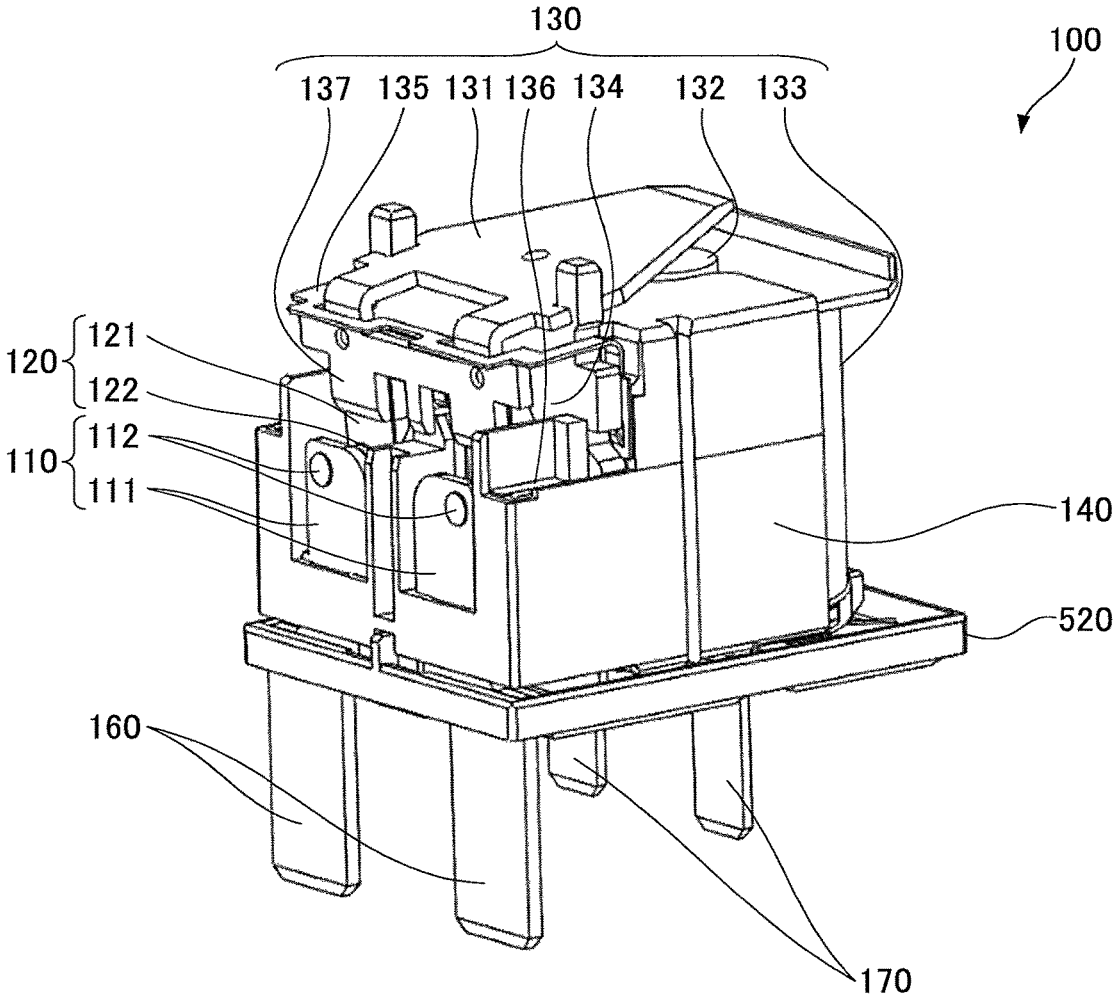
FIG. 1 is a view illustrating an overall structure of an electromagnetic relay.

The invention will be described herein with reference to illustrative embodiments. It is to be noted that, in the explanation of the drawings, the same components are given the same reference numerals, and explanations are not repeated.

First Embodiment (1. Overall Structure of Electromagnetic Relay)

First, an overall structure of an electromagnetic relay of the embodiment is described. FIG. 1 is a view illustrating the overall structure of the electromagnetic relay under a status in which an outer cover is removed.

As illustrated in FIG. 1, an electromagnetic relay 100 includes a fixed contact portion 110, a movable contact portion 120, an electromagnetic device 130, and a bottom plate 520. The fixed contact portion 110, the movable contact portion 120 and the electromagnetic device 130 are fixed by a base mold 140 and the bottom plate 520. Further, terminals 160 and 170 protrude at a lower side of the base mold 140 and the bottom plate 520.

The fixed contact portion 110 includes two fixed contact springs 111 and two fixed contacts 112, and the two fixed contact springs 111 are connected to two terminals 160, respectively. Similarly, the movable contact portion 120 includes two movable contact springs and two movable contacts, that are provided to face with the corresponding two fixed contact spring 111 and the two fixed contacts 112, respectively. The two movable contact springs are connected to an armature 131 via a holding member 137.

The electromagnetic device 130 includes the armature 131, a magnetic core 132, a coil 133, a yoke (soft iron) 134, a hinge spring 135, arc-extinguishing yokes 136 and the holding member 137.

The armature 131 is configured to be operated to rotate around an upper end portion of the yoke 134 as a fulcrum. When the armature 131 is operated to rotate around the upper end portion of the yoke 134 as a fulcrum, the movable contact portion 120 connected to the armature 131 via the holding member 137 is operated to reciprocate between a contacting position at which the movable contacts 122 and the fixed contacts 112 contact, and a non-contacting position at which the movable contacts 122 and the fixed contacts 112 do not contact.

Further, the armature 131 absorbs to and moves away from an end surface (magnetic core surface) of the magnetic core 132. Specifically, when electromagnetic force is generated due to voltage applied to the terminals 170 connected to the coil 133, the armature 131 adsorbs to the magnetic core surface. As a result, the movable contact portion 120 is operated to move to the contacting position with the fixed contact portion 110. Here, when the movable contact portion 120 is operated to move to the contacting position with the fixed contact portion 110, one of the terminals 160 is electrically connected to the other of the terminals 160 via one of the fixed contacts and movable contacts, and the other of the movable contacts and fixed contacts.

The hinge spring 135 pushes the armature 131 in a direction that the armature 131 moves away from the magnetic core surface. As the hinge spring 135 always pushes the armature 131 in a direction in which the armature 131 moves away from the magnetic core surface, if the application of the voltage to the terminals 170 is terminated, the armature 131 moves away from the magnetic core surface due to the pushing force of the hinge spring and the movable contact portion 120 is operated to move to the non-contacting position with the fixed contact portion 110. Then, the movable contact portion 120 is maintained at the non-contacting position until the voltage is applied to the terminals 170 next. The structure of the hinge spring 135 is described later in detail.

The arc-extinguishing yokes 136 are provided at both sides of the contacting positions of the movable contacts 122 and the fixed contacts 112. The arc-extinguishing yokes 136 have a function to increase magnetic force of permanent magnets (not illustrated in the drawings) that are provided to extinguish arc generated between the fixed contacts 112 and the movable contacts 122 when the movable contact portion 120 is operated to move to the non-contacting position from the contacting position with the fixed contact portion 110.

(2. Structure of Hinge Spring)

Figure 2A:
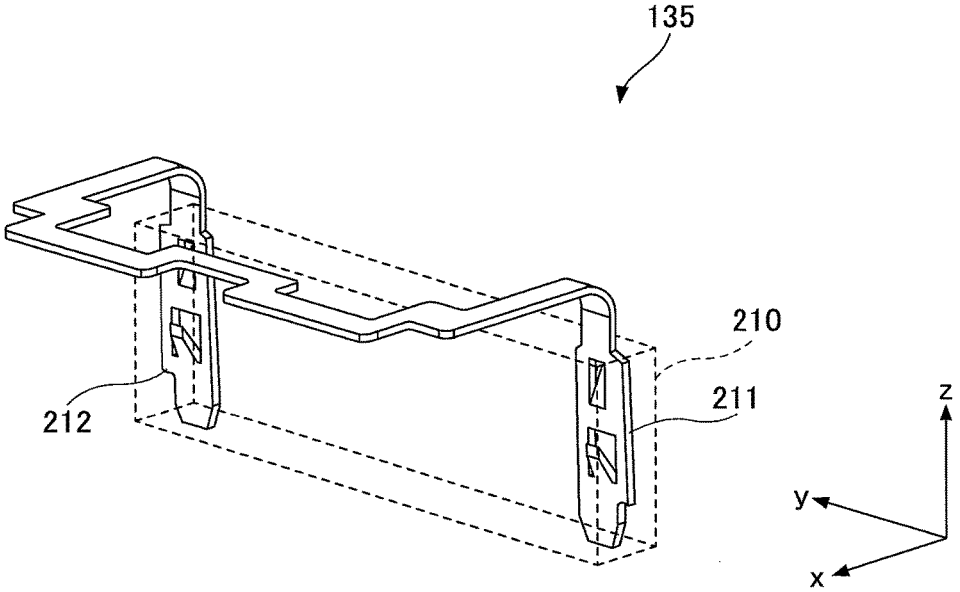
FIG. 2A is a view illustrating a structure of a hinge spring.
Figure 2B:
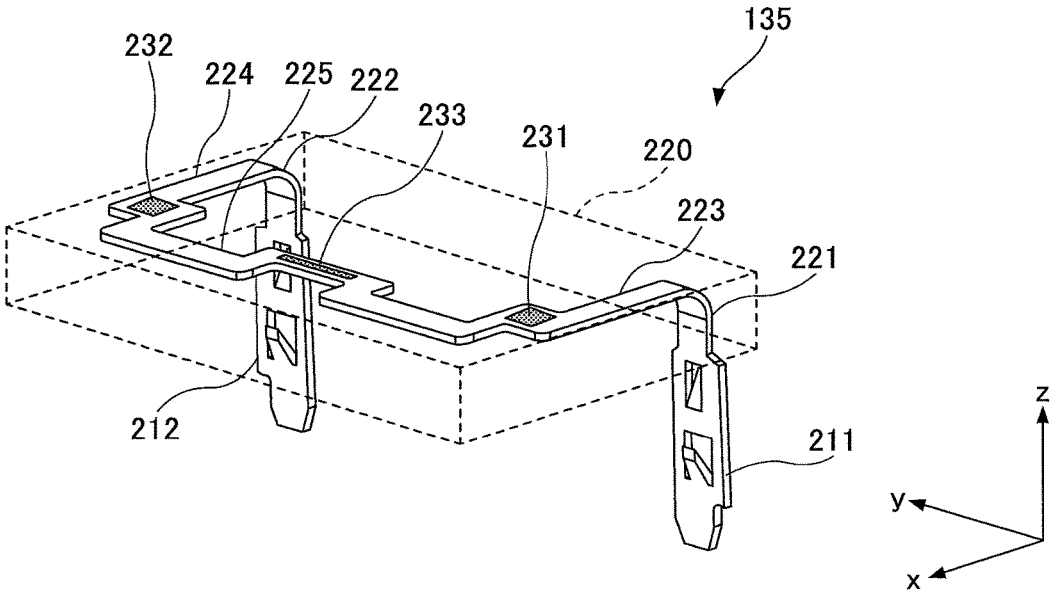
FIG. 2B is a view illustrating a structure of the hinge spring.

Next, a structure of the hinge spring 135 is described. FIG. 2A and FIG. 2B are views illustrating the structure of the hinge spring 135. As illustrated in FIG. 2A and FIG. 2B, the hinge spring 135 includes a fixed part 210 that is fixed to the electromagnetic device 130, and a pushing part 220 that provides pushing force for pushing the armature 131. In order to describe the shape of the hinge spring 135, x, y and z axes are defined in the example of FIG. 2A and FIG. 2B.

As illustrated in FIG. 2A, the fixed part 210 includes members 211 and 212 extending in a z-axis direction.

Further, as illustrated in FIG. 2B, the pushing part 220 includes a member 221 extending in the z-axis direction from the member 211, and a member 222 extending in the z-axis direction from the member 212. Further, the pushing part 220 includes a member 223, extending in an x-axis direction, formed by bending an end portion of the member 221 opposite to a side at which the member 211 is connected, and a member 224, extending in the x-axis direction, formed by bending an end portion of the member 222 opposite to a side at which the member 212 is connected.

Further, the pushing part 220 includes a member 225, extending in an y-axis direction, whose one end is connected to an end portion of the member 223 opposite to a side at which the member 221 is connected, and the other end is connected to an end portion of the member 224 opposite to a side at which the member 222 is connected.

The pushing part 220 is formed to be laterally symmetrical with respect to a center position in the y-axis direction when seen in the x-axis direction and the z-axis direction. This means that the pushing part 220 is formed to be plane symmetrical (symmetry of reflection) with respect to an x-z plane passing at the center position of the y-axis direction.

The members 223 and 224 of the pushing part 220 are provided with a first contacting region 231 and a second contacting region 232, respectively, and the member 225 is provided with a third contacting region 233. The pushing part 220 pushes the armature 131 in the direction that the armature 131 moves away from the magnetic core surface by contacting a part of the armature 131 at the first contacting region 231, the second contacting region 232 and the third contacting region 233.

As such, according to the shape of the hinge spring 135 of the embodiment, the pushing part 220 contacts the armature 131 at the plurality of regions to push the armature 131. The shape of the hinge spring 135 is not limited to that illustrated in FIG. 2A and FIG. 2B, and may be configured to push the armature 131 at least at one contacting region. This means that the hinge spring 135 may be configured to include either one contacting region among the first contacting region 231, the second contacting region 232 and the third contacting region 233.

Further, the hinge spring may not be configured as a single component. For example, two independent hinge springs, that are one hinge spring including the members 211, 221 and 223, and another hinge spring including the member 212, and the members 222 and 224 of the pushing part 220, may be provided.

(3. Description about Fixed Position, Pushing Position and Pushing Direction of Hinge Spring)

Next, a fixed position of the hinge spring 135, and a pushing position and a pushing direction of the hinge spring 135 with respect to the armature 131 in the electromagnetic device 130 are described.

Figure 3A:
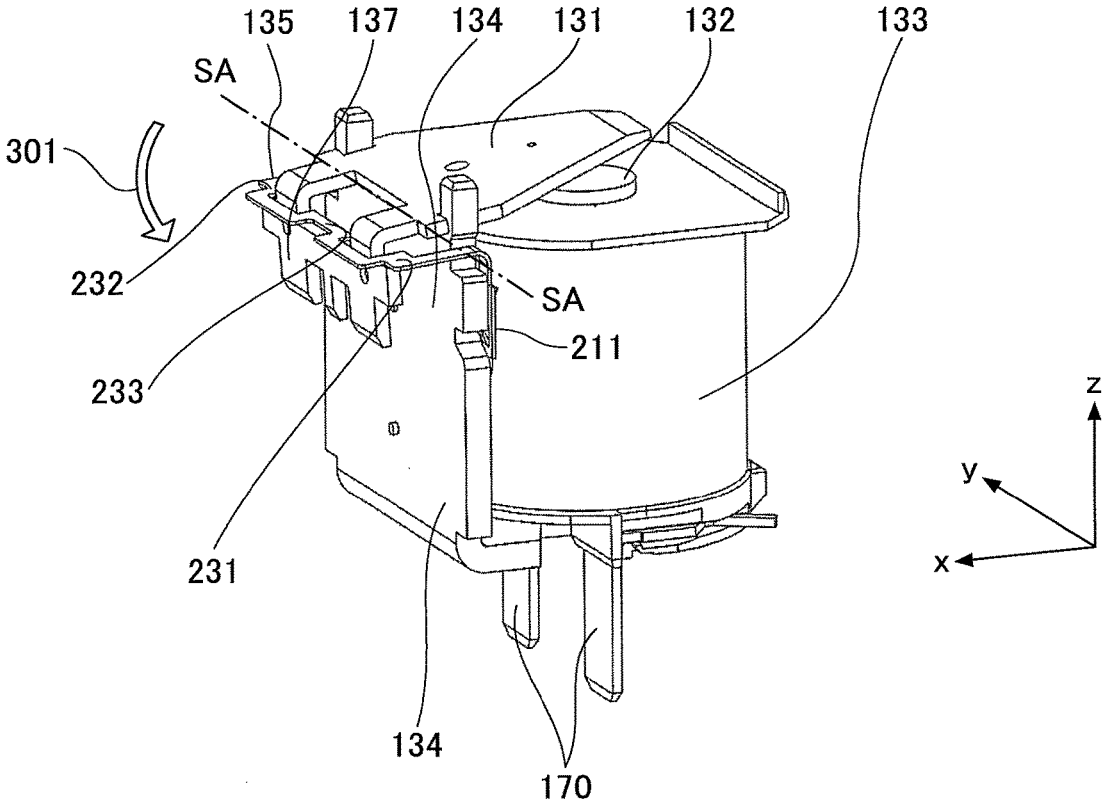
FIG. 3A is a view for describing a pushing position and a pushing direction of the hinge spring to an armature, and a fixed position in the electromagnetic device.
Figure 3B:
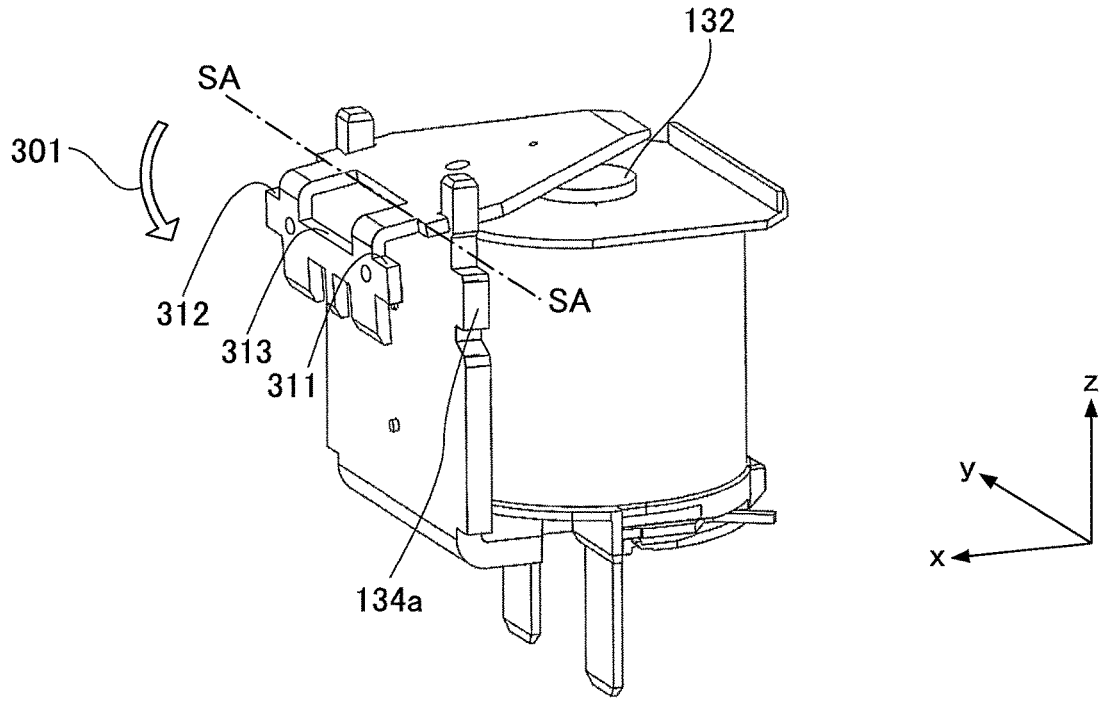
FIG. 3B is a view for describing the pushing position and the pushing direction of the hinge spring to the armature, and the fixed position in the electromagnetic device.

FIG. 3A and FIG. 3B are views for describing the fixed position, the pushing position and the pushing direction of the hinge spring 135. Here, for the example of FIG. 3A, in order to facilitate the description of the fixed position, the pushing position and the pushing direction, the fixed contact portion 110, the movable contact portion 120, the base mold 140, the bottom plate 520, the terminals 160 and the like are omitted. Further, for the example of FIG. 3B, the hinge spring 135 is further omitted.

As illustrated in FIG. 3A, the member 211 of the fixed part 210 of the hinge spring 135 is fixed at a fitting portion, not illustrated in FIG. 3A and FIG. 3B, that is provided on the outside of a side surface of the armature 131 in the y-axis direction, and also at a magnetic core surface side with respect to the fulcrum SA (upper end portion of the yoke 134) of the rotation of the armature 131 in the x-axis direction. Here, although only one of the members, the member 211, of the fixed part 210 of the hinge spring 135 is illustrated for the example of FIG. 3A and FIG. 3B, similarly, the other of the members, the member 212, is fixed at a fitting portion, not illustrated, that is provided on the outside of a side surface of the armature 131 in the y-axis direction, and at a magnetic core surface side with respect to the fulcrum SA (the upper end portion of the yoke 134) of the rotation of the armature 131 in the x-axis direction.

The first contacting region 231, the second contacting region 232 and the third contacting region 233 of the pushing part 220 of the hinge spring 135 contact parts 311 to 313 (see FIG. 3B) of the armature that are positioned at an opposite side of the magnetic core surface while interposing the fulcrum therebetween in the x-axis direction, respectively. With this configuration, the pushing part 220 pushes the parts 311 to 313 of the armature in a direction of an arrow 301. As a result, when the electromagnetic force is not generated, the armature 131 moves away from the magnetic core surface, and the movable contacts 122 and the fixed contacts 112 do not contact with each other.

Figure 4:
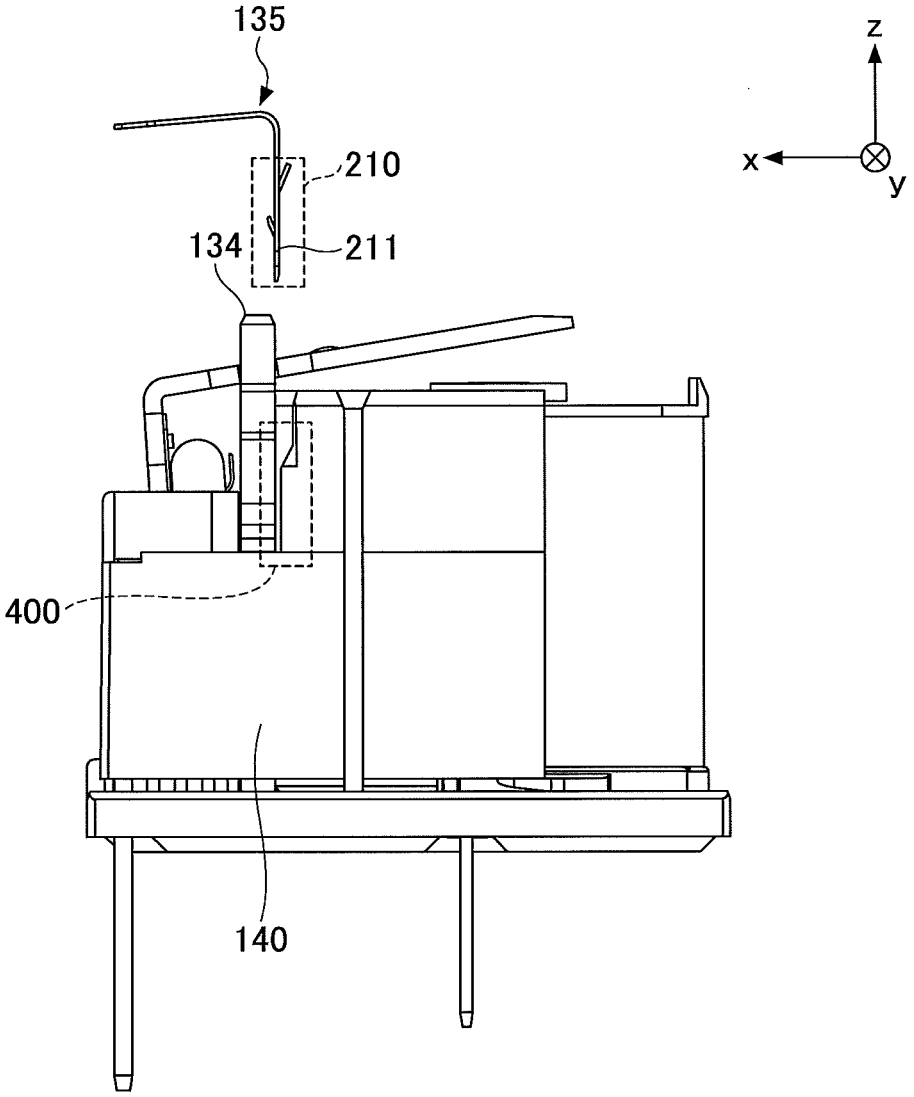
FIG. 4 is a side view of the electromagnetic relay.

The fitting portion at which the member 211 of the fixed part 210 of the hinge spring 135 is fixed is illustrated in FIG. 4. FIG. 4 is a side view illustrating the electromagnetic relay 100 where the outer cover is removed. As illustrated in FIG. 4, the member 211 of the fixed part 210 of the hinge spring 135 is fixed at a space between the yoke 134 and the base mold 140. The space between the yoke 134 and the base mold 140 functions as a fitting portion 400. Here, similarly, the member 212 of the fixed part 210 of the hinge spring 135 is fixed at a space (not illustrated in FIG. 4) between the yoke 134 and the base mold 140.

(4. Merits of Hinge Spring)

Figure 5A:
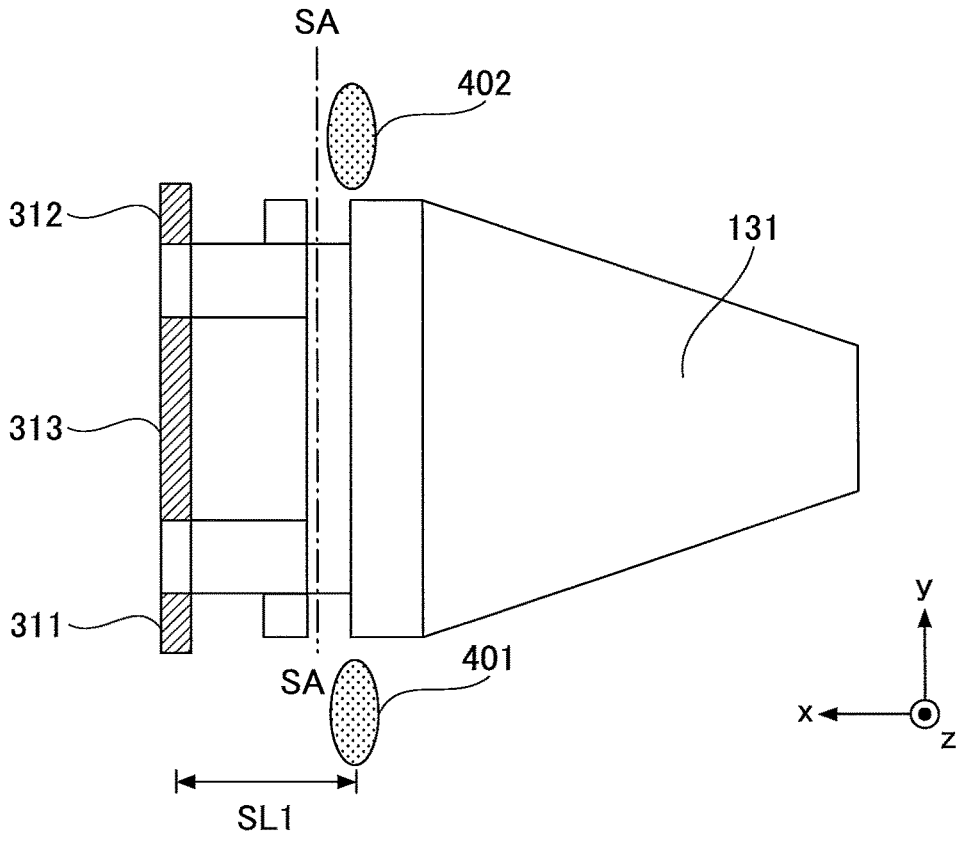
FIG. 5A is a view for describing a merit of using the hinge spring of the embodiment.
Figure 5B:
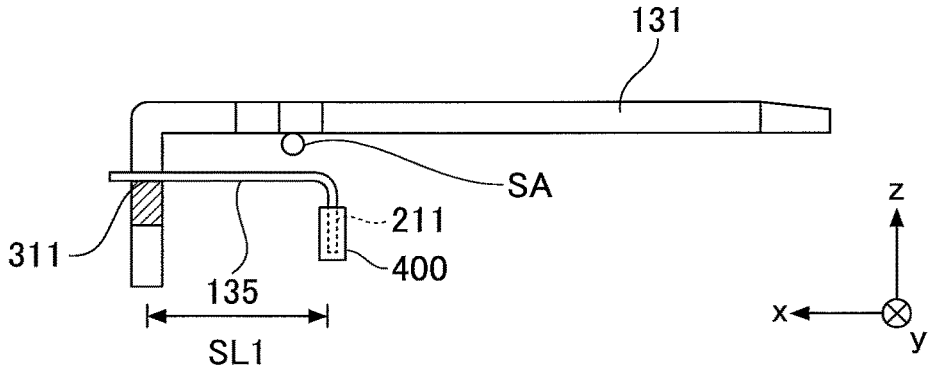
FIG. 5B is a view for describing a merit of using the hinge spring of the embodiment.
Figure 5C:
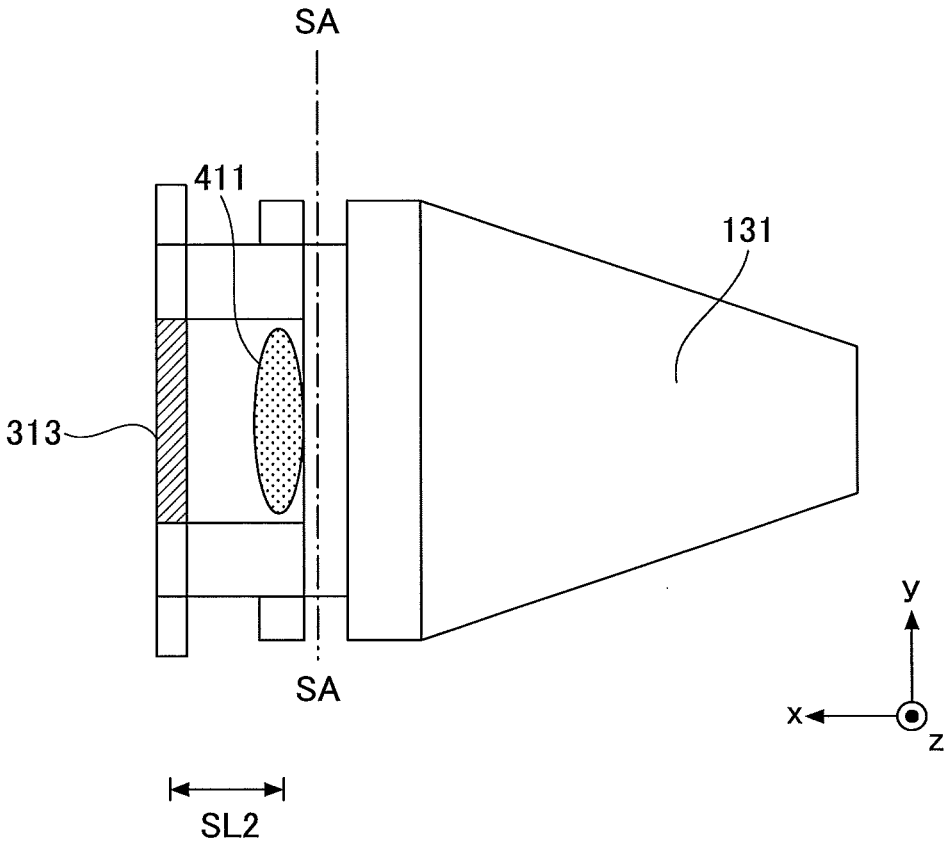
FIG. 5C is a view for describing a merit of using the hinge spring of the embodiment.
Figure 5D:
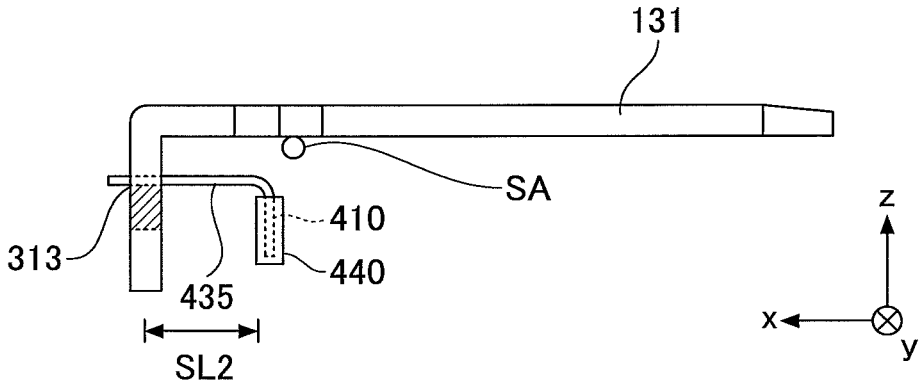
FIG. 5D is a view for describing a merit of using the hinge spring of the embodiment.

Next, merits of using the hinge spring 135 of the embodiment are described. FIG. 5A to FIG. 5D are views for describing the merits of using the hinge spring 135 of the embodiment. In FIG. 5A to FIG. 5D, in order to describe the merits of using the hinge spring 135, a side view of the hinge spring 135, and a plan view and a side view of the armature 131 are illustrated in FIG. 5A and FIG. 5B. Meanwhile, a side view of a hinge spring 435 of a comparative example, and a plan view and a side view of the armature 131 are illustrated in FIG. 5C and FIG. 5D when the hinge spring 435 is used to push the armature 131.

As illustrated in FIG. 5A and FIG. 5B, according to the embodiment, the member 211 of the hinge spring 135 is fixed at the fitting portion 400 provided at a fixed position 401 on the outside of one side surface of the armature 131 in the y-axis direction. Similarly, the member 212 is fixed at the fitting portion provided at a fixed position 402 on the outside of the other side surface of the armature 131 in the y-axis direction. Thus, when attaching the hinge spring 135 to the electromagnetic device 130, the fixed part 210 does not interfere with the armature 131.

On the other hand, for the case of the hinge spring 435 illustrated in FIG. 5C and FIG. 5D, a fixed part 410 is fixed at a fitting portion 440 provided at a fixed position 411 on the inside of the armature 131 in the y-axis direction. The fitting portion 440 is a member to fix the fixed part 410 of the hinge spring 435, and is provided inside of the armature 131 in the y-axis direction. Thus, when attaching the hinge spring 435 to the electromagnetic device, there is risk that the fixed part 410 interferes with the armature 131, and it is necessary to attach the hinge spring 435 while avoiding the interference with the armature 131.

This means that, according to the hinge spring 135 of the embodiment, when comparing with the hinge spring 435 of FIG. 5C and FIG. 5D, by changing the fixed position 411 to the fixed positions 401 and 402, attachment of the hinge spring 135 to the electromagnetic device 130 is facilitated. As a result, an electromagnetic relay easy to assemble can be provided.

Further, as illustrated in FIG. 5A and FIG. 5B, according to the hinge spring 135 of the embodiment, the member 211 of the fixed part 210 is fixed at the fitting portion 400 at the fixed position 401 that is at the magnetic core surface side with respect to the fulcrum SA in the x-axis direction. Further, the member 212 of the fixed part 210 is fixed at the fitting portion (not illustrated in the drawings) at the fixed position 402 that is at the magnetic core surface side with respect to the fulcrum SA in the x-axis direction. Thus, the length of spring SL1 of the hinge spring 135 can be made longer.

On the other hand, for the hinge spring 435 illustrated in FIG. 5C and FIG. 5D, the fixed part 410 is fixed at the fitting portion 440 at the fixed position 411 that is opposite of the magnetic core surface while interposing the fulcrum SA therebetween in the x-axis direction (fixed at a position between the yoke 134 and the movable contact portion). Thus, the length of spring SL2 of the hinge spring 435 cannot be made longer.

This means that according to the hinge spring 135 of the embodiment, by changing the fixed position of the hinge spring 435 of FIG. 5B (411 to 401 and 402), the length of spring SL1 of the hinge spring 135 is elongated. When the length of spring SL1 of the hinge spring 135 is elongated, an allowable range of a manufacturing error in manufacturing the hinge spring 135 can be broadened.

(5. Method of Attaching Hinge Spring)

Figure 6A:
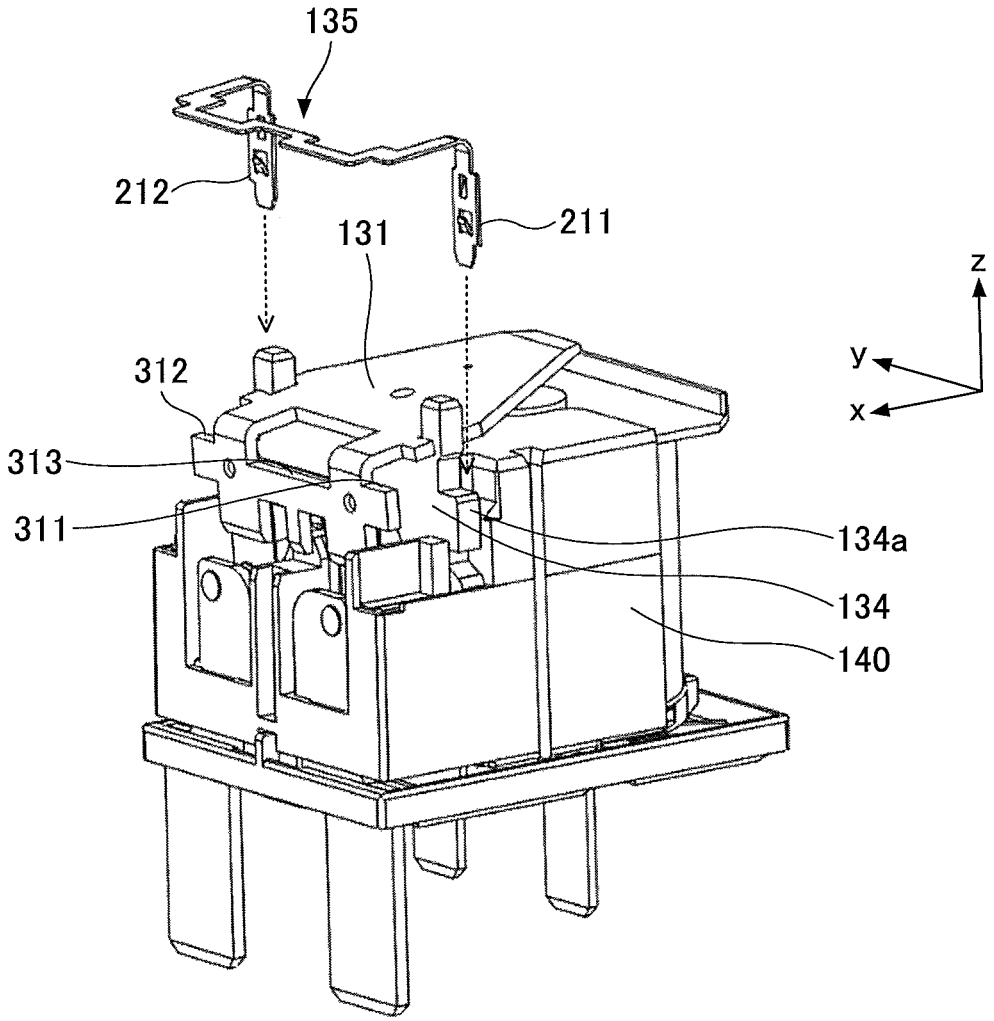
FIG. 6A is a view for describing a method of attaching the hinge spring in detail.
Figure 6B:
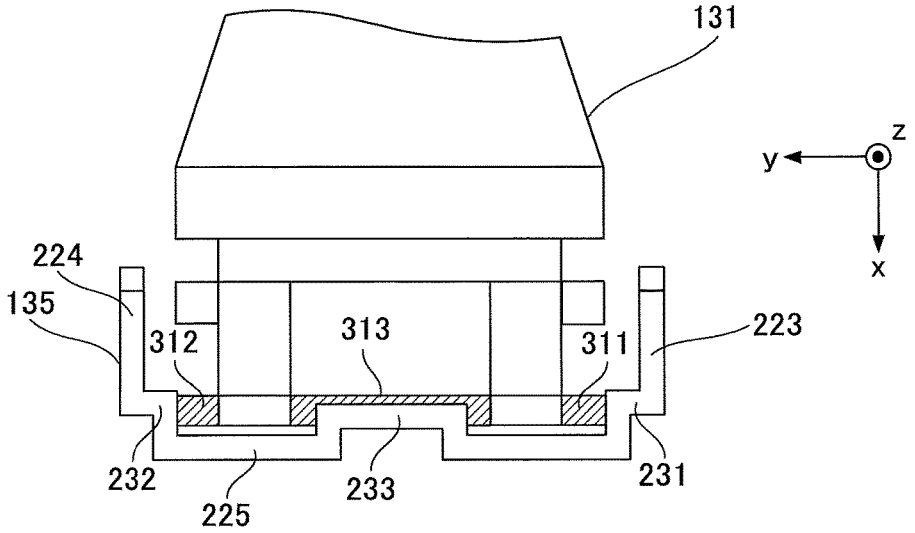
FIG. 6B is a view for describing a method of attaching the hinge spring in detail.

Next, a method of attaching the hinge spring 135 is described in detail. FIG. 6A and FIG. 6B are views for describing the method of attaching the hinge spring 135 in detail.

As illustrated in FIG. 6A and FIG. 6B, when attaching the hinge spring 135 of the embodiment to the electromagnetic device 130, the hinge spring 135 is moved from an upper side to a lower side of the armature 131 (in a minus direction of the z-axis) under a status that the armature 131 is attached to the yoke 134. Here, as illustrated in FIG. 4, the fitting portions 400 are formed such that the members 211 and 212 of the fixed part 210 of the hinge spring 135 fit in the z-axis direction. Thus, in an assembling operation of the electromagnetic relay 100, an operator can fix the members 211 and 212 of the fixed part 210 of the hinge spring 135 in the fitting portions by moving the hinge spring 135 from the upper side toward the lower side of the armature 131.

As described above, as the fitting portion 400 and the like are provided on the outsides of the side surfaces of the armature 131 in the y-axis direction, the fixed part 210 of the hinge spring 135 and the armature 131 do not interfere with each other when the operator moves the hinge spring 135 from the upper side to the lower side of the armature 131.

Further, FIG. 6B is a plan view, seen from an upper direction, illustrating a status in which the hinge spring 135 is attached. As illustrated in FIG. 6B, the members 223 to 225 that extend in the x-axis direction and the y-axis direction, among the pushing part 220 of the hinge spring 135, have shapes that satisfy the following conditions.

The first to third contacting regions 231 to 233 contact the parts 311 to 313 of the armature 131, respectively, under a status that the hinge spring 135 is attached.

A region of the hinge spring 135 other than the first to third contacting regions 231 to 233 does not contact with the armature 131 when attaching and after attaching the hinge spring 135.

This means that the pushing part 220 is formed to have a planar shape in which the pushing part 220 of the hinge spring 135 and the armature 131 do not interfere with each other at a region other than the first to third contacting regions 231 to 233, when the hinge spring 135 is moved in the minus direction of the z-axis.

In other words, among the members 223 to 225 extending in the x-axis direction and the y-axis direction in the pushing part 220, the region other than the first to third contacting regions 231 to 233 have a planar shape that extends along an outside of the planar shape of the armature 131 (an outer shape when seen from an upper side).

Thus, the fixed part 210 of the hinge spring 135 can be easily fitted in the fitting portion 400 and the like. This means that the attachment of the hinge spring 135 to the electromagnetic device 130 is facilitated.

(6. Detailed Shape of Hinge Spring)

Figure 7A:
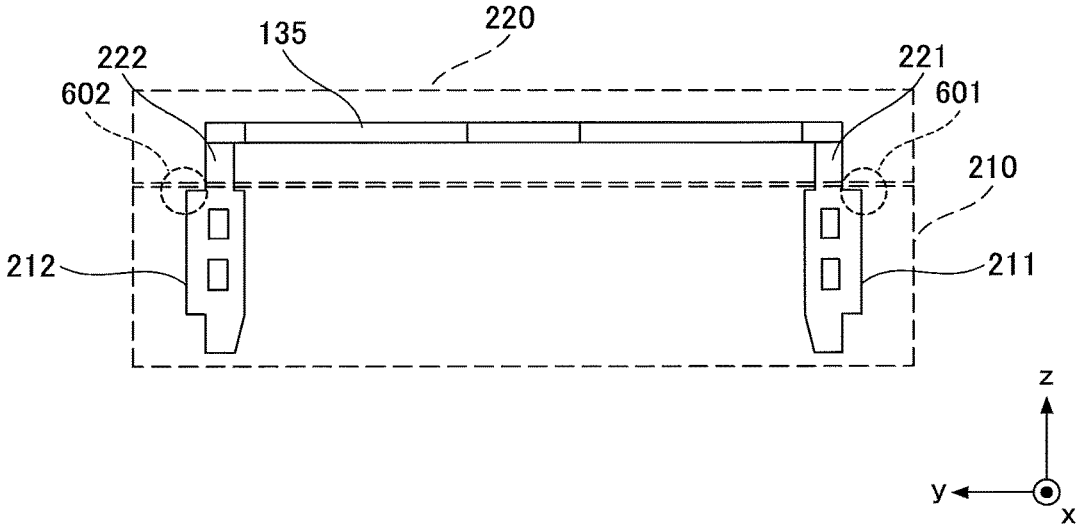
FIG. 7A is a view for describing a shape of the hinge spring in detail.
Figure 7B:
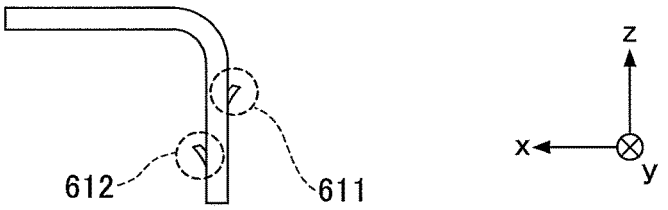
FIG. 7B is a view for describing a shape of the hinge spring in detail.

Next, the shape of the hinge spring is described in detail. FIG. 7A and FIG. 7B are views for describing the shape of the hinge spring 135 in detail.

FIG. 7A is an elevation view when the hinge spring 135 is seen from a front side, and FIG. 7B is a side view when the hinge spring 135 is seen from a side surface.

As illustrated in FIG. 7A, the width of each of the members 211 and 212 of the fixed part 210 is formed to be wider than the width of each of the members 221 and 222 of the pushing part 220, a shoulder portion 601 is formed at the member 211 in the y-axis direction, and further, a shoulder portion 602 is formed at the member 212 in the y-axis direction. Thus, it is possible for the operator to push the shoulder portions 601 and 602 in the z-axis direction when fitting the fixed part 210 of the hinge spring 135 in the fitting portion 400 and the like, in the assembling operation of the electromagnetic relay 100. This means that it is unnecessary for the operator to push the members 223 to 225 or the like of the pushing part 220 in the z-axis direction when fitting the fixed part 210 of the hinge spring 135 in the fitting portion 400 and the like. With this configuration, the operator can easily attach the hinge spring 135 without generating a problem that the pushing part 220 is deformed when attaching the hinge spring 135.

Here, as illustrated in FIG. 7B, each of the members 211 and 212 of the fixed part 210 is provided with cut standing portions 611 and 612 that limit movements in a fitting direction (minus direction of the z-axis) and an opposite direction (plus direction of the z-axis) when being fitted in the fitting portion 400 and the like. Among them, the cut standing portion 612 is cut and stood in a plus direction of the x-axis. The cut standing portion 612 has a function to hook its front end at the fitting portion 400 and the like, when force in an opposite direction (plus direction of the z-axis) of the fitting direction (minus direction of the z-axis) when being fitted in the fitting portion 400 and the like is applied to the fixed part 210. With this, the fixed part 210 of the hinge spring 135 is prevented from the fitting portion 400 and the like at the cut standing portion 612.

Figure 8:
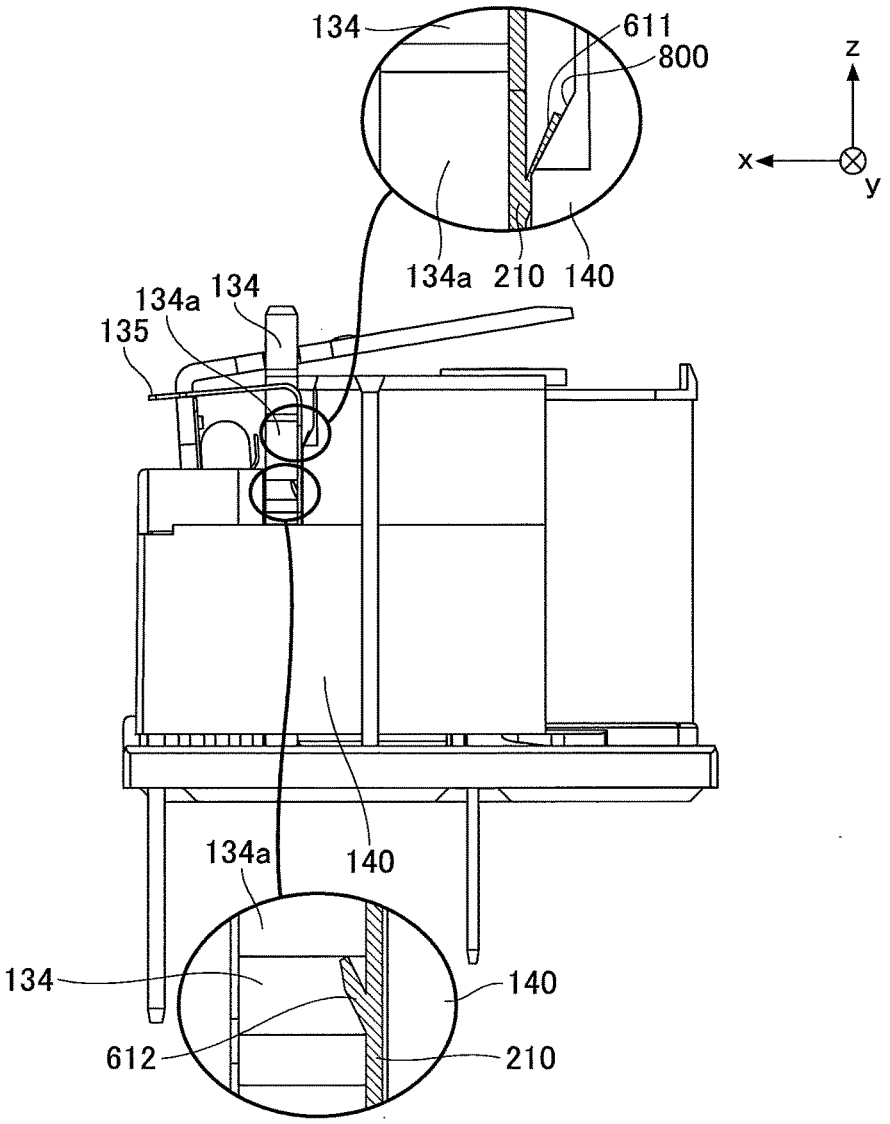
FIG. 8 is a view illustrating a status in which a fixed part of the hinge spring is fitted in a fitting portion.

FIG. 8 is a view illustrating a status in which the fixed part 210 of the hinge spring 135 is fitted in the fitting portion 400. As illustrated in FIG. 8, the front end of the cut standing portion 612 is hooked at a lower end of a protrusion 134*a* (see FIG. 3B) formed at the yoke 134. Thus, even when the force in the opposite direction (plus direction of the z-axis) of the fitting direction (minus direction of the z-axis) of the hinge spring 135 is applied to the fixed part 210, the fixed part 210 of the hinge spring 135 does not pull out from the fitting portion 400.

Meanwhile, the cut standing portion 611 is cut and stood in a minus direction of the x-axis. As the cut standing portion 611 pushes the fitting portion 400 and the like in the minus direction of the x-axis, force from the fitting portion 400 and the like is applied. This means that as the pushing part 220 of the hinge spring 135 is pushed in the plus direction of the x-axis, force generated when the hinge spring 135 pushes the armature 131 can be strengthened, compared with a case when the cut standing portion 611 is not provided.

As illustrated in FIG. 8, the cut standing portion 611 contacts an inclined surface 800 of the base mold 140. As the cut standing portion 611 has spring characteristics, the cut standing portion 611 that contacts the inclined surface 800 pushes the pushing part 220 of the hinge spring 135 in the plus direction of the x-axis.

(7. Summary)

As is apparent from the above description, according to the electromagnetic relay of the embodiment, The fixed part 210 of the hinge spring 135 is configured to be fixed on the outsides of the side surfaces of the armature 131 and at the magnetic core surface side with respect to the fulcrum of the rotation of the armature 131, when forming the hinge spring 135.

The fitting direction of the fitting portion 400 is configured to match a moving direction of the hinge spring 135 when attaching the hinge spring so that the hinge spring 135 can be attached to the electromagnetic device 130 by moving the hinge spring 135 from an upper side toward a lower side of the armature 131.

The planar shape of the pushing part 220 of the hinge spring 135 is configured to extend along an outer planar shape of the armature 131 so that the pushing part 220 of the hinge spring 135 does not interfere with the armature 131 when attaching the hinge spring 135.

With this, attachment of the hinge spring 135 to the electromagnetic device 130 is facilitated and an assembling operation of the electromagnetic relay 100 can be improved.

Further, it is possible to elongate the length of spring SL of the hinge spring, and an allowable range of a manufacturing error of the hinge spring can be broadened.

Second Embodiment

Although the fitting depth when fitting the fixed part 210 of the hinge spring 135 in the fitting portion 400 (see FIG. 4) is constant in the above described first embodiment, the present invention is not limited to this, and a structure in which the fitting depth can be arbitrarily changed may be adopted. This is because, by changing the fitting depth, pushing force of the hinge spring 135 to push the armature 131 can be finely adjusted.

Here, the fitting depth for being fitted in the fitting portion 400 may be adjusted by inserting a metal piece having a thickness and a width similar to those of the member 211 or 212 of the fixed part 210 of the hinge spring 135 in the fitting portion 400 and the like, for example. In particular, by preparing a plurality of metal pieces with different heights, the fitting depth can be finely adjusted.

Third Embodiment (1. Overall Structure of Body Portion of Electromagnetic Relay)

Figure 9:
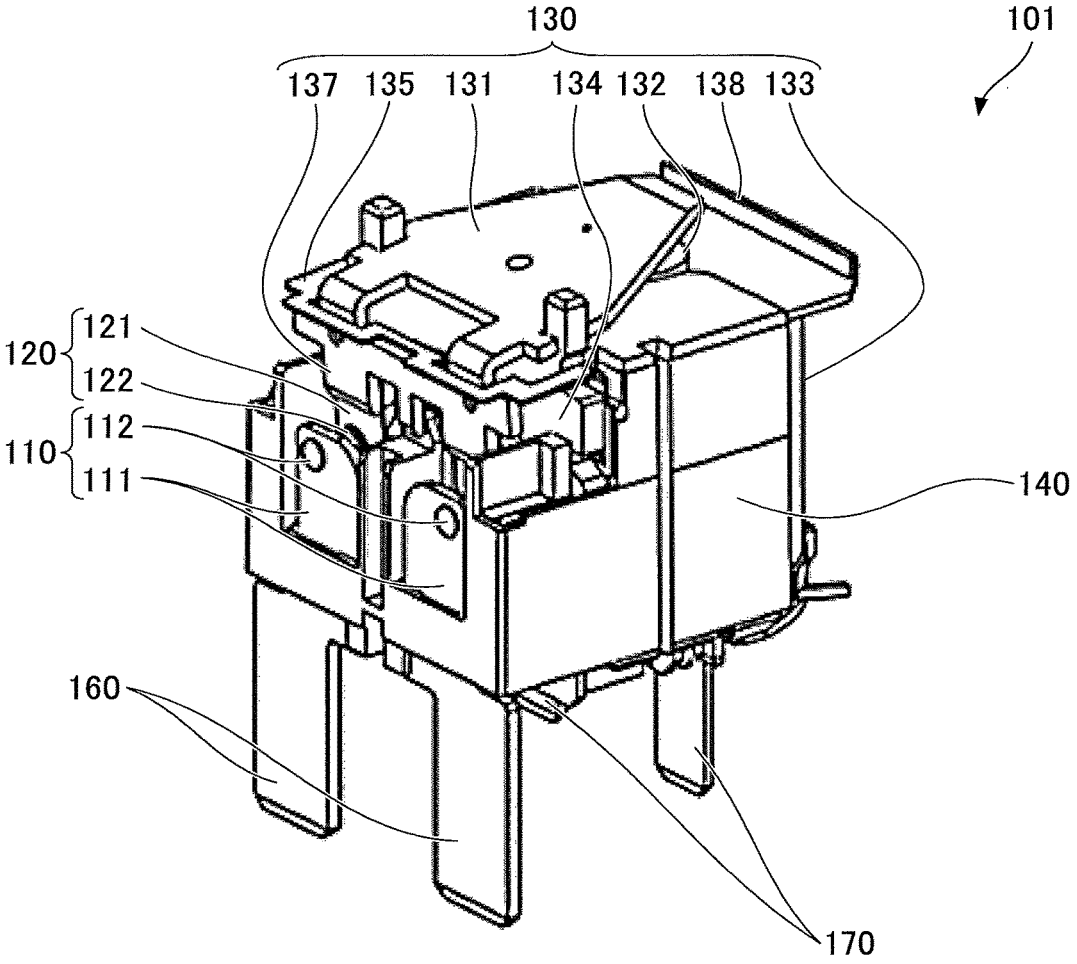
FIG. 9 is a view illustrating an overall structure of a body portion of an electromagnetic relay.

First, an overall structure of an electromagnetic relay of the embodiment is described. FIG. 9 is a view illustrating the overall structure of a body portion 101 of the electromagnetic relay in which an outer cover and a bottom plate are removed.

As illustrated in FIG. 9, the body portion 101 of the electromagnetic relay includes a fixed contact portion 110, a movable contact portion 120 and an electromagnetic device 130, and the fixed contact portion 110, the movable contact portion 120 and the electromagnetic device 130 are fixed by a base mold 140 or the like. Further, two terminals 160 and two terminals 170 protrude at a lower side of the base mold 140.

The fixed contact portion 110 includes two fixed contact springs 111 and two fixed contacts 112, and the fixed contact springs 111 are connected to different terminals 160, respectively. Similarly, the movable contact portion 120 includes two movable contact springs and two movable contacts, that are provided to face with the corresponding fixed contact springs 111 and the fixed contacts 112, respectively. Further, the two movable contact springs are connected to an armature 131 via a holding member 137. In FIG. 9, only one movable contact spring 121 among the two movable contact springs, and one movable contact 122 among the two movable contacts are illustrated.

The electromagnetic device 130 includes the armature 131, a magnetic core 132, a coil 133, a spool 138, a yoke (soft iron) (hereinafter, referred to as a "driving yoke" in order to differentiate from an arc-extinguishing yoke, which will be described below.) 134, a hinge spring 135 and the holding member 137.

Figure 10A:
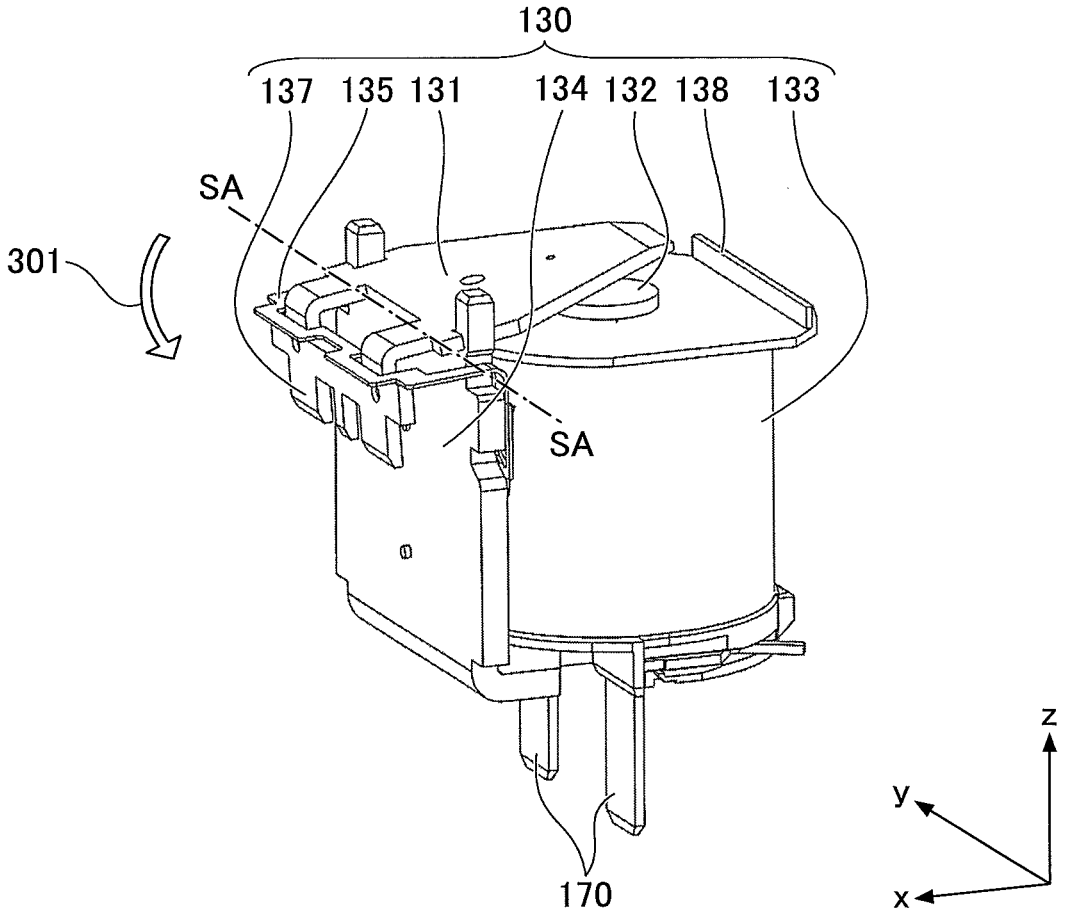
FIG. 10A is a view illustrating a structure of each component of the body portion of the electromagnetic relay.

With reference to FIG. 10A as well, the armature 131 is provided to be rotatable around an upper end portion of the driving yoke 134 as a fulcrum SA. When the armature 131 is operated to rotate around the upper end portion of the driving yoke 134 as a fulcrum SA, the movable contact portion 120 connected to the armature 131 via the holding member 137 is operated to reciprocate between a contacting position at which the movable contacts and the fixed contacts contact, and a non-contacting position at which the movable contacts and the fixed contacts do not contact.

Further, the armature 131 absorbs to and moves away from an end surface (magnetic core surface) of the magnetic core 132 that is inserted in the spool 138. Specifically, when electromagnetic force is generated due to voltage applied to the terminals 170 connected to the coil 133 that is wound around the spool 138 (when an electromagnet formed by the magnetic core 132, the coil 133 and the spool 138 is excited), the armature 131 absorbs to the magnetic core surface. As a result, the movable contact portion 120 is operated to the contacting position. When the movable contact portion 120 is operated to the contacting position, the two movable contacts 122 and the two fixed contacts 112 contact with each other, respectively. Thus, one of the terminals 160 is electrically connected to the other of the terminals 160 via one of the fixed contacts 112 and the movable contacts 122, and the other of the movable contacts 122 and the fixed contacts 112.

The hinge spring 135 pushes the armature 131 in a direction that the armature 131 moves away from the magnetic core surface. Thus, if the application of the voltage to the terminals 170 is terminated, the armature 131 moves away from the magnetic core surface, and the movable contact portion 120 is operated to the non-contacting position. Then, the movable contact portion 120 is maintained at the non-contacting position until the voltage is applied to the terminals 170 next.

(2. Structure of Each Part of Body Portion of Electromagnetic Relay)

Next, structures of parts of the body portion 101 of the electromagnetic relay are described with reference to FIG. 10A to FIG. 100. FIG. 10A is a view illustrating a structure of the electromagnetic device 130, among parts of the body portion 101 of the electromagnetic relay, and the fixed contact portion 110, the movable contact portion 120, the base mold 140, the terminals 160 and the like are omitted for explanation purposes.

As illustrated in FIG. 10A, the driving yoke 134 is formed to have an L shape, and its bottom portion is provided near a bottom surface of the spool 138. An upper end portion of the driving yoke 134 functions as a fulcrum SA when the armature 131 is operated to rotate in a direction of an arrow 301. The magnetic core 132 that causes the armature 131 to adsorb to and move away from is inserted in the spool 138. The coil 133 is wound at an outer periphery surface of the spool 138.

Figure 10B:
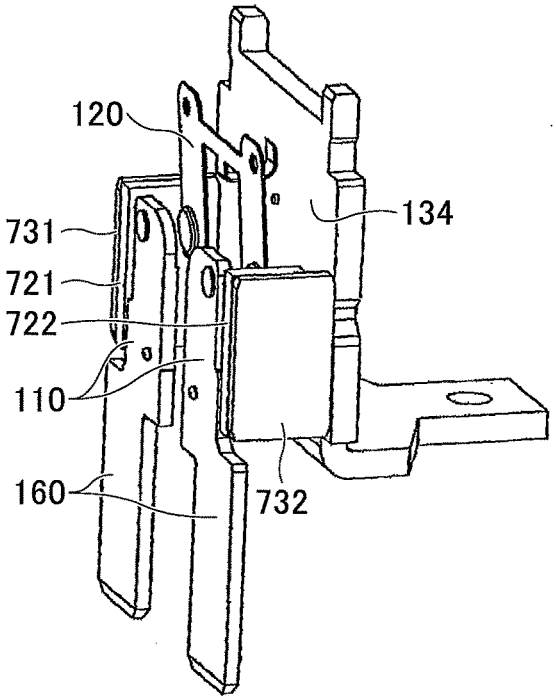
FIG. 10B is a view illustrating a structure of each component of the body portion of the electromagnetic relay.
Figure 10C:
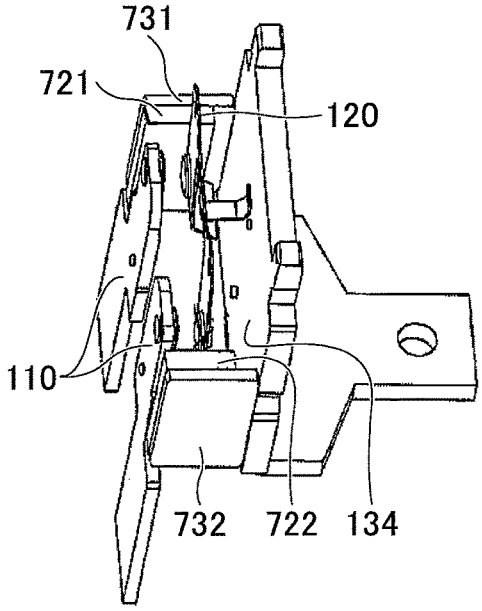
FIG. 10C is a view illustrating a structure of each component of the body portion of the electromagnetic relay.

FIG. 10B and FIG. 100 are views illustrating structures of the fixed contact portion 110 and the movable contact portion 120, and parts around the fixed contact portion 110 and the movable contact portion 120, among the parts of the body portion 101 of the electromagnetic relay. In FIG. 10B and FIG. 100, the armature 131, the magnetic core 132, the coil 133, the spool 138, the hinge spring 135, the holding member 137, the base mold 140, the terminals 170 and the like are omitted for explanation purposes.

As illustrated in FIG. 10B and FIG. 100, a plurality of permanent magnets 721 and 722, which are an example of magnetic members, are disposed at side surfaces of the fixed contact portion 110 and the movable contact portion 120 that are disposed to be face with each other. The permanent magnets 721 and 722 are disposed to face with each other while interposing the fixed contact portion 110 and the movable contact portion 120, and exert magnetic force on the fixed contact portion 110 and the movable contact portion 120. With this, the permanent magnets 721 and 722 extinguish arc generated between the movable contact portion 120 and the fixed contact portion 110, when the movable contact portion 120 is operated from the contacting position to the non-contacting position, or the movable contact portion 120 is operated from the non-contacting position to the contacting position.

Further, as illustrated in FIG. 10B and FIG. 100, a plurality of arc-extinguishing yokes 731 and 732, as arc-extinguish yoke portions, are attached to the driving yoke 134 in a contacting manner. The arc-extinguishing yokes 731 and 732 are positioned outside of the permanent magnets 721 and 722 and increase the effect of the magnetic force by the permanent magnets 721 and 722. Here, the structure of the arc-extinguishing yokes 731 and 732 is described in the following in detail.

(3. Structure of Arc-Extinguishing Yoke in Detail)

Figure 11A:
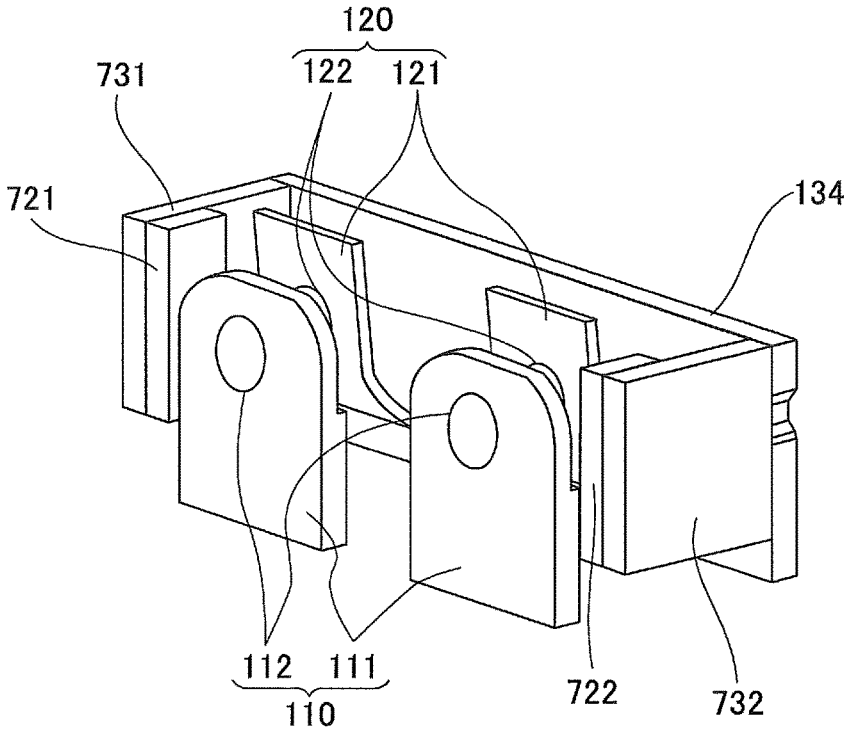
FIG. 11A is a view illustrating a structure of an arc-extinguishing yoke of the electromagnetic relay in detail.
Figure 11B:
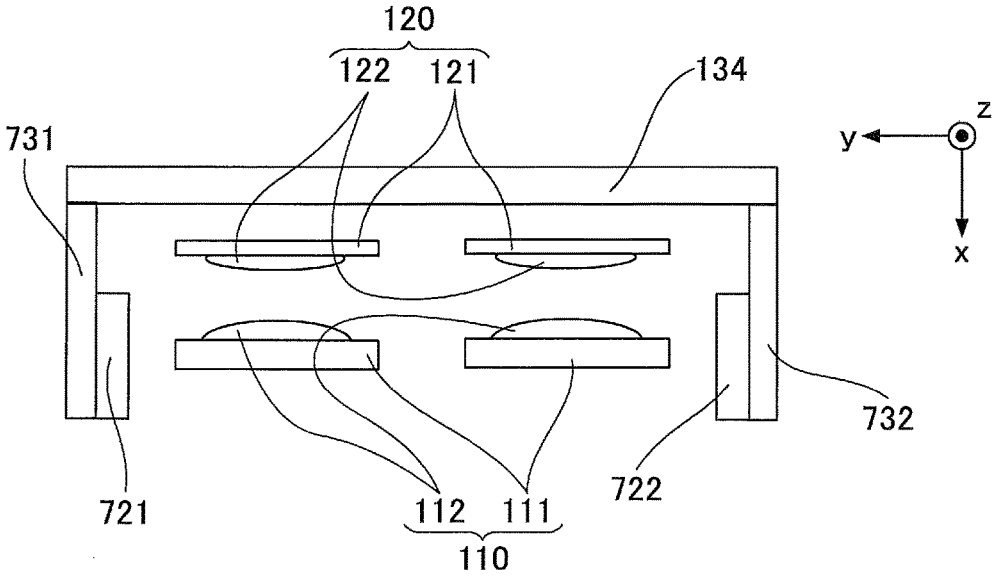
FIG. 11B is a view illustrating a structure of the arc-extinguishing yoke of the electromagnetic relay in detail.

FIG. 11A and FIG. 11B are views illustrating structures of the arc-extinguishing yokes 731 and 732 in detail. Among them, FIG. 11A is a perspective view of the vicinity of a position where the arc-extinguishing yokes 731 and 732 are disposed, and FIG. 11B is a plan view of the vicinity of a position where the arc-extinguishing yokes 731 and 732 are disposed.

As illustrated in FIG. 11A, each of the permanent magnets 721 and 722 and the arc-extinguishing yokes 731 and 732 has a flat plate shape. The arc-extinguishing yokes 731 and 732 are larger than the permanent magnets 721 and 722. The permanent magnets 721 and 722 are disposed such that one surface of each of the permanent magnets 721 and 722 faces a surface of each of the arc-extinguishing yokes 731 and 732, and the other surfaces of the permanent magnets 721 and 722 face with each other. This means that the arc-extinguishing yokes 731 and 732 cover outside surfaces of the permanent magnets 721 and 722, respectively. Further, one side surface of each of the arc-extinguishing yokes 731 and 732 contacts the driving yoke 134. Here, the arc-extinguishing yokes 731 and 732 contact the driving yoke 134 at the outermost positions of the driving yoke 134 in a width direction of the driving yoke 134.

Thus, as illustrated in FIG. 11B, when a status in which the arc-extinguishing yokes 731 and 732 are attached is seen from an upper side, the arc-extinguishing yokes 731 and 732 and the driving yoke 134 are formed to have a U shape in a plan view in a minus direction of the z-axis of FIG. 10A.

In this embodiment, an arc-extinguishing yoke having a U shape is formed, not by placing an arc-extinguishing yoke having a U shape, but by sharing the driving yoke 134 as a part of the arc-extinguishing yoke.

As such, by sharing a part that constitutes one side of the U shape structure with another part, in other words, the driving yoke 134, the arc-extinguishing yokes 731 and 732 can improve the arc-extinguishing capability of the permanent magnets 721 and 722 to an extent about the same as a case when an arc-extinguishing yoke having a U shape is placed. Further, when disposing the arc-extinguishing yokes 731 and 732, a space can be saved compared with a case when an arc-extinguishing yoke having a U shape is disposed.

(4. Method of Attaching Arc-Extinguishing Yokes and Permanent Magnets)

Figure 12:
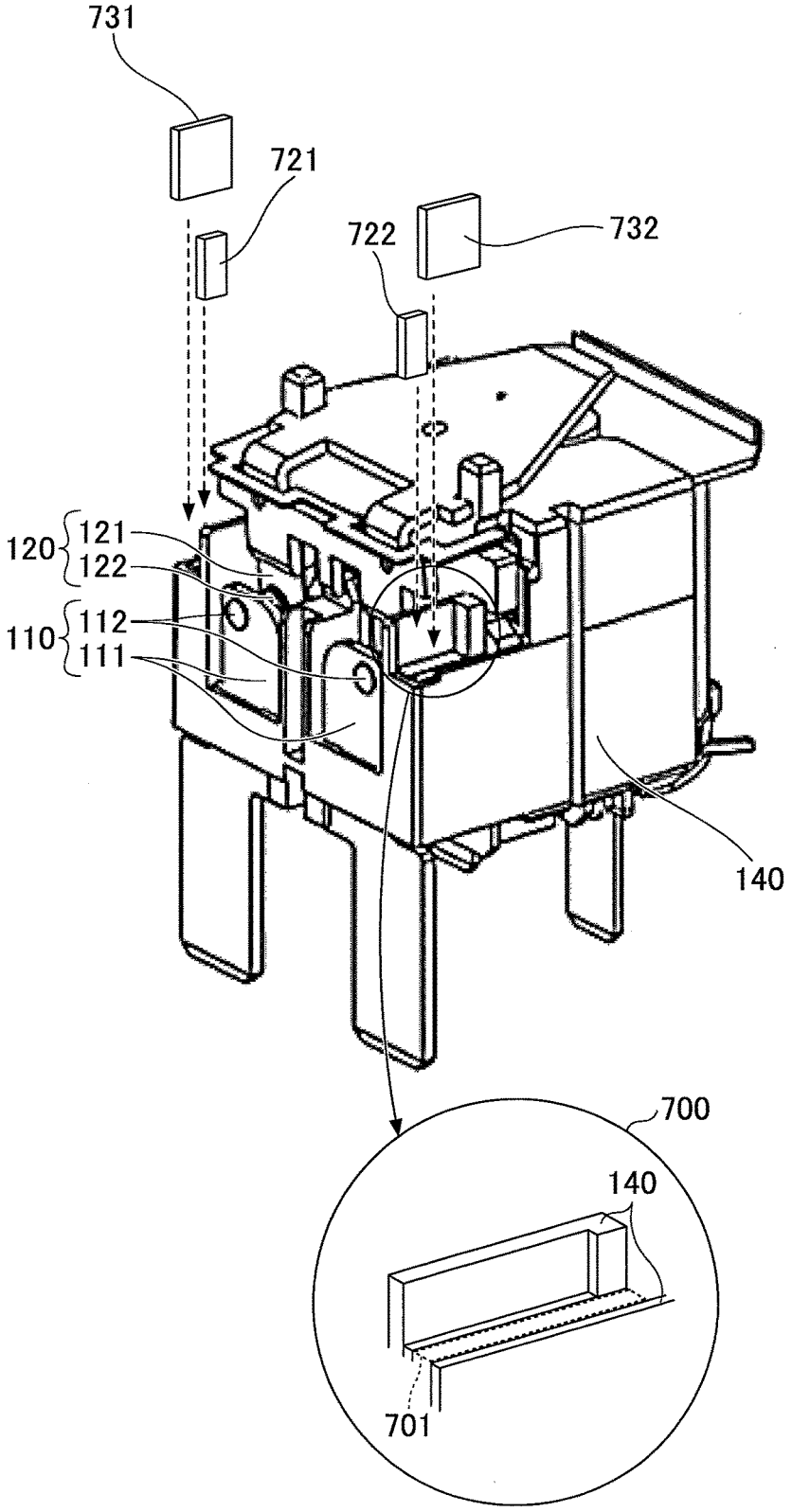
FIG. 12 is a view for describing an attachment of permanent magnets and the arc-extinguishing yokes.

Next, a method of attaching the arc-extinguishing yokes 731 and 732 and the permanent magnets 721 and 722 is described. FIG. 12 is a view illustrating an attachment of the arc-extinguishing yokes 731 and 732 and the permanent magnets 721 and 722.

As illustrated in a partially enlarged region 700 of FIG. 12, the base mold 140 is provided with an open portion 701 for inserting the arc-extinguishing yoke 732 and the permanent magnet 722 from an upper side. Although not illustrated in FIG. 12, the base mold 140 is further provided with an open portion for inserting the arc-extinguishing yoke 731 and the permanent magnet 721 from the upper side.

By inserting the arc-extinguishing yokes 731 and 732 and the permanent magnets 721 and 722 from the upper side in the respective open portions, respectively, the arc-extinguishing yokes 731 and 732 and the permanent magnets 721 and 722 are disposed at side surfaces of the fixed contact portion 110 and the movable contact portion 120. At this time, the arc-extinguishing yokes 731 and 732 and the permanent magnets 721 and 722 are disposed in a positional relationship with respect to the driving yoke 134 as illustrated in FIG. 11A and FIG. 11B.

(5. Outer Cover and Bottom Plate)

Figure 13:
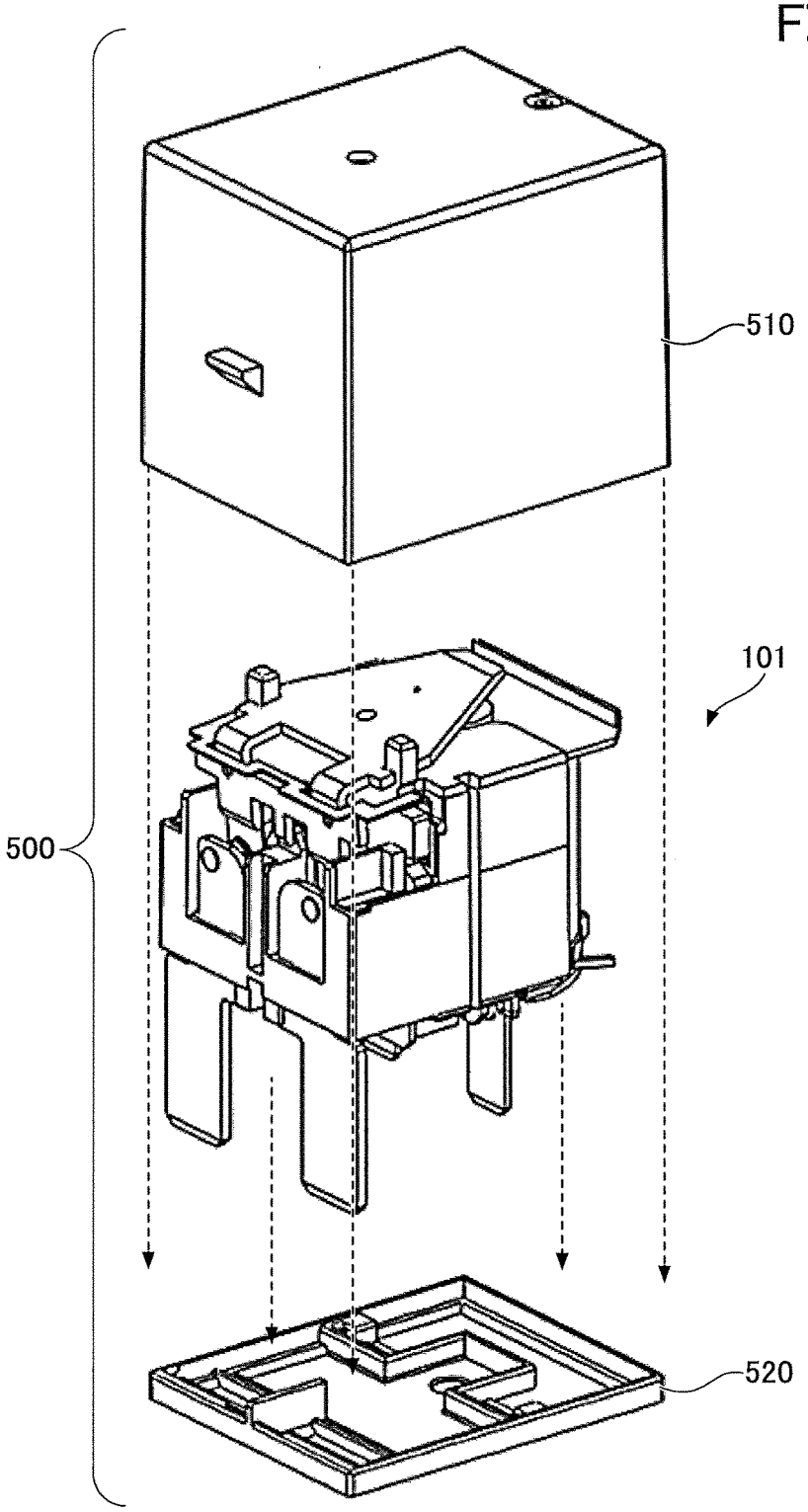
FIG. 13 is a view illustrating an outer cover and a bottom plate of the electromagnetic relay.

Next, the outer cover and the bottom plate of the electromagnetic relay are described. FIG. 13 is a view illustrating an outer cover and a bottom plate that cover the body portion 101 of the electromagnetic relay. As illustrated in FIG. 13, an outer cover 510 and a bottom plate 520 are attached to the body portion 101 of the electromagnetic relay. With this, the outer cover 510 and the bottom plate 520 forms an external surface of the electromagnetic relay 500, and the electromagnetic relay 500 is formed in which the body portion 101 of the electromagnetic relay is covered by the outer cover 510 and the bottom plate 520.

Figure 14A:
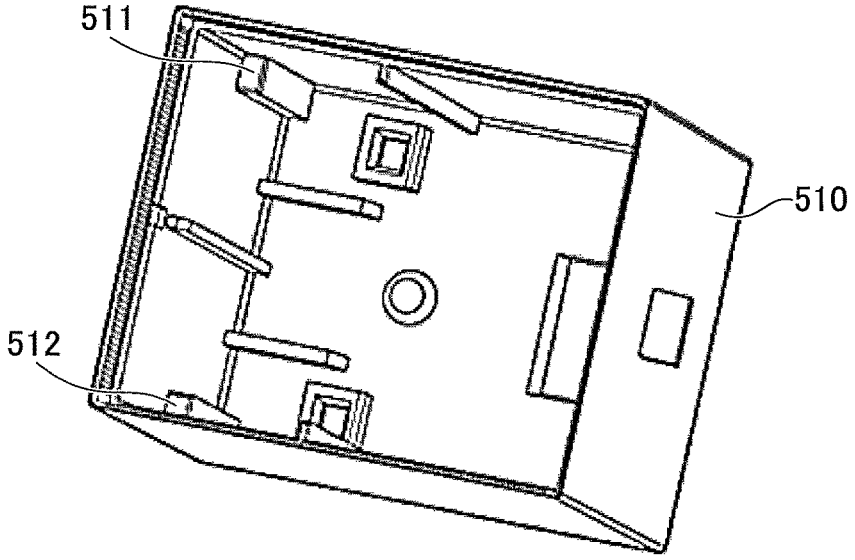
FIG. 14A is a view illustrating an inside shape of an outer cover and a contacting status of contacting portions.
Figure 14B:
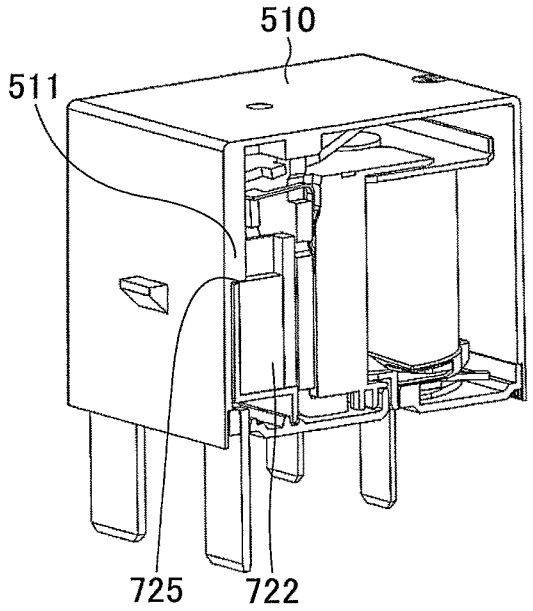
FIG. 14B is a view illustrating an inside shape of an outer cover and a contacting status of contacting portions.
Figure 14C:
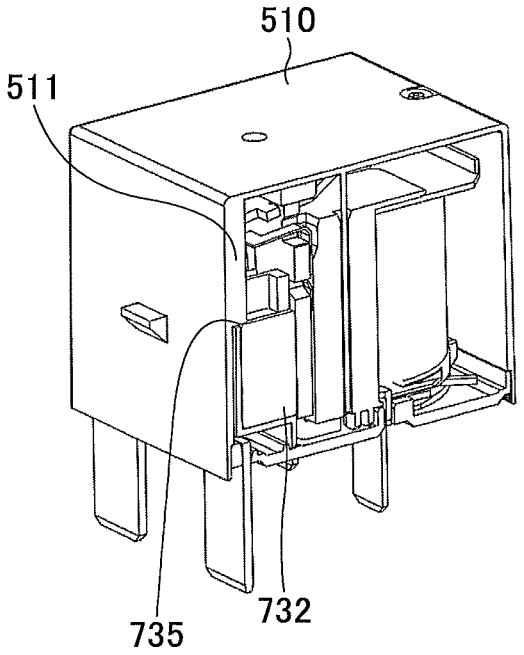
FIG. 14C is a view illustrating an inside shape of an outer cover and a contacting status of contacting portions.

Here, the outer cover 510 has a function to fix the arc-extinguishing yokes 731 and 732 and the permanent magnets 721 and 722 by covering the body portion 101 of the electromagnetic relay and contacting with the arc-extinguishing yokes 731 and 732 and the permanent magnets 721 and 722. FIG. 14A to FIG. 14C are views illustrating an inside shape and a contacting status of contacting portions of the outer cover 510.

As illustrated in FIG. 14A, contacting portions 511 and 512 are provided in the outer cover 510. The outer cover 510 is configured such that, when being attached to the body portion 101 of the electromagnetic relay, lower surfaces of the contacting portions 511 and 512 contact with upper surfaces of the permanent magnets 721 and 722 and the arc-extinguishing yokes 731 and 732, respectively. FIG. 14B illustrates a status in which the lower surface of the contacting portion 511 contacts with the upper surface 725 of the permanent magnet 722. Further, FIG. 14C illustrates a status in which the contacting portion 511 contacts with the upper surface 735 of the arc-extinguishing yoke 732. Further, although not illustrated in the drawings, the lower surface of the contacting portion 512 contacts with the upper surface of the permanent magnet 721 and the upper surface of the arc-extinguishing yoke 731.

With this, the arc-extinguishing yokes 731 and 732 and the permanent magnets 721 and 722 are fixed to the contacting portions 511 and 512 of the outer cover 510, and these parts are prevented from slipping down from the open portion 701 and the like.

(6. Summary)

As is apparent from the above description, according to the electromagnetic relay of the embodiment, The permanent magnets 721 and 722 and the arc-extinguishing yokes 731 and 732 are disposed at side surfaces of the fixed contact portion 110 and the movable contact portion 120 such that to face with each other while interposing the fixed contact portion 110 and the movable contact portion 120 therebetween.

The arc-extinguishing yokes 731 and 732 are attached at the outermost positions of the driving yoke 134 in its width direction, and the arc-extinguishing yokes 731 and 732 and the driving yoke 134 are configured to form a U shape structure in a plan view.

As such, by sharing the driving yoke as a part of the arc-extinguishing yoke, a space can be saved compared with a case when an arc-extinguishing yoke having a U shape is disposed while improving the arc-extinguishing capability of the permanent magnets to an extent about the same as a case when the arc-extinguishing yoke having the U shape is disposed.

Fourth Embodiment

Although the arc-extinguishing yokes 731 and 732 are attached to the driving yoke 134 such that side surfaces of the arc-extinguishing yokes 731 and 732 contact with the driving yoke 134 in the above described third embodiment, the present invention is not limited to this. For example, the arc-extinguishing yokes 731 and 732 may be attached to the driving yoke 134 such that a space is provided between a side surface of each of the arc-extinguishing yokes 731 and 732 and the driving yoke 134. Further, although the arc-extinguishing yokes 731 and 732 and the driving yoke 134 are configured to be separate parts in the above described first embodiment, the present invention is not limited to this. For example, the arc-extinguishing yokes 731 and 732 may be integrally formed with the driving yoke 134 such that to extend from the driving yoke 134.

This means that, the arc-extinguishing yokes 731 and 732, included by the driving yoke 134 as the arc-extinguish yoke portions, may be separately formed from the driving yoke 134 or integrally formed with the driving yoke 134. Further, for a case when the arc-extinguishing yokes 731 and 732 are separately formed, the arc-extinguishing yokes 731 and 732 may be attached to the driving yoke 134 in a contacting manner, or the arc-extinguishing yokes 731 and 732 may be attached to the driving yoke 134 with spaces therebetween, respectively.

The present invention is not limited to the specifically disclosed embodiments, and numerous variations and modifications may be made without departing from the spirit and scope of the present invention.

The present application is based on and claims the benefit of priority of Japanese Priority Application No. 2014-149904 filed on Jul. 23, 2014 and Japanese Priority Application No. 2014-161825 filed on Aug. 7, 2014, the entire contents of which are hereby incorporated by reference.

NUMERALS

100 electromagnetic relay
101 body portion of electromagnetic relay
110 fixed contact portion
111 fixed contact spring
112 fixed contact
120 movable contact portion
121 movable contact spring
122 movable contact
130 electromagnetic device
131 armature
132 magnetic core
133 coil
134 driving yoke
135 hinge spring
137 holding member
138 spool
140 base mold
160 terminal
170 terminal
210 fixed part
220 pushing part
231 first contacting region
232 second contacting region
233 third contacting region
400 fitting portion
401 fixed position
402 fixed position
500 electromagnetic relay
510 outer cover
511 contacting portion
512 contacting portion
520 bottom plate
601 shoulder portion
602 shoulder portion
611 cut standing portion
612 cut standing portion
721 permanent magnet
722 permanent magnet
731 arc-extinguishing yoke
732 arc-extinguishing yoke

What is claimed is:

1. An electromagnetic relay comprising:

a fixed contact portion including a fixed contact;

a movable contact portion including a movable contact that contacts the fixed contact; and an electromagnetic device that operates the movable contact portion so that the movable contact contacts the fixed contact, wherein the electromagnetic device includes an armature that adsorbs to a magnetic core surface of the electromagnetic device and operates the movable contact portion by rotating with respect to a fulcrum, a hinge spring that pushes a part of the armature at an opposite side of the magnetic core surface while interposing the fulcrum between the hinge spring and the magnetic core surface so that the armature moves away from the magnetic core surface, and a fixed member that fixes an end portion of the hinge spring while having outside of a side surface of the armature as a fixed position, and wherein the fixed member is configured to be capable of fixing the end portion of the hinge spring by moving the hinge spring from an upper side to a lower side of the armature, when attaching the hinge spring.

2. The electromagnetic relay according to claim 1, wherein the fixed member fixes the end portion of the hinge spring at a fixed position that is at a magnetic core surface side with respect to the fulcrum.

3. The electromagnetic relay according to claim 2, wherein the fixed member is configured such that a moving direction when the hinge spring is moved from an upper side to a lower side of the armature, and a fitting direction when fitting the end portion of the hinge spring match with each other, when attaching the hinge spring.

4. The electromagnetic relay according to claim 1, wherein the hinge spring includes a first hinge spring whose end portion is fixed on the outside of one side surface of the armature, and a second hinge spring whose end portion is fixed on the outside of the other side surface of the armature.

5. An electromagnetic relay comprising:

a contact portion including a fixed contact and a movable contact that faces and contacts the fixed contact;

an electromagnet;

a yoke that includes a plate portion interposed between the electromagnet and the contact portion;

a plurality of arc-extinguishing yoke portions that are disposed to face with each other while interposing the fixed contact and the movable contact therebetween, the plurality of arc-extinguishing yoke portions being provided to extend from the plate portion of the yoke;

an armature, operated in accordance with an excitation of the electromagnet, that operates the movable contact between a position at which the fixed contact contacts the movable contact, and a position at which the fixed contact and the movable contact are apart from each other; and a plurality of magnetic portions attached at one surfaces of the arc-extinguishing yoke portions, respectively, and disposed to face with each other while interposing the fixed contact and the movable contact therebetween.

6. The electromagnetic relay according to claim 5, wherein the plurality of arc-extinguishing yoke portions are configured as separate bodies from the yoke, and are disposed such that side surfaces of the arc-extinguishing yoke portions contact with the plate portion of the yoke.

7. The electromagnetic relay according to claim 5, wherein the plurality of arc-extinguishing yoke portions are integrally formed with the plate portion of the yoke.

8. The electromagnetic relay according to claim 5, further comprising an outer cover that forms an external surface of the electromagnetic relay, and includes contacting portions that contact the plurality of arc-extinguishing yoke portions, respectively, inside thereof.

* * * * *